United States Patent [19]

Nunomura et al.

[11] Patent Number: 4,757,235

[45] Date of Patent: Jul. 12, 1988

[54] ELECTROLUMINESCENT DEVICE WITH MONOLITHIC SUBSTRATE

[75] Inventors: Keiji Nunomura; Kazuaki Utsumi; Yoshio Sano, all of Tokyo, Japan

[73] Assignee: NEC Corporation, Tokyo, Japan

[21] Appl. No.: 857,374

[22] Filed: Apr. 30, 1986

[30] Foreign Application Priority Data

Apr. 30, 1985 [JP] Japan ..... 60-92884
Jul. 5, 1985 [JP] Japan ..... 60-148617

[51] Int. Cl.[4] ..... H05B 33/26

[52] U.S. Cl. ..... 313/509; 313/506; 428/432; 428/917

[58] Field of Search ..... 313/506, 509, 512; 428/432, 917; 427/66; 445/46, 49

[56] References Cited

U.S. PATENT DOCUMENTS 3,127,534 3/1964 Diemer ..... 313/509
4,418,118 11/1983 Lindfors ..... 313/509 X

FOREIGN PATENT DOCUMENTS 59-5268 1/1984 Japan .

OTHER PUBLICATIONS

IEEE Transactions on Electron Devices, Jul. 1977, vol. ED-24, No. 7, pp. 903-908.
IEEE Transactions on Electron Devices, Jun. 1981, vol. ED-28, No. 6, pp. 698-702.
Proceedings of 3rd International Display Research Conference, Japan Display, '83, Oct. 3-5, 1983, pp. 76-79.
International Symposium Digest of Technical Papers, Society for Information Display, May, 1974, pp. 84-85.

*Primary Examiner*—David K. Moore
*Assistant Examiner*—K. Wieder
*Attorney, Agent, or Firm*—Burns, Doane Swecker & Mathis

[57] ABSTRACT

An electroluminescent device and corresponding methods for making the same are described. A thin film structure is disposed on top of a ceramic substrate having electrodes embedded therein. Ceramic material of high dielectric constant separates the internal electrodes from the thin-film structure including a transparent electrode layer, a luminescent layer, and at least one insulating layer. The ceramic material may be divided into first and second segments of different dielectric constant, and the internal electrodes may also be divided into separate segments. The manufacturing process includes the preparation of a ceramic green sheet having a dielectric constant greater than 200, printing electrodes on this sheet, and laminating and sintering this sheet together with other green sheets to form a monolithic member over which a further electroluminescent layer and transparent electrodes can be disposed.

12 Claims, 4 Drawing Sheets

ELECTROLUMINESCENT DEVICE WITH MONOLITHIC SUBSTRATE

BACKGROUND OF THE INVENTION

This invention relates to an electroluminescent (EL) device and more particularly to an alternate current (AC)-drive thin-film EL device and a method of manufacturing the same.

The AC-drive thin-film EL device has excellent brightness and stability characteristics and is widely used for various types of displays. A typical double insulated type thin-film EL device comprises a transparent glass substrate and multi-layers of thin films of a transparent electrode, a thin-film first insulator layer, a thin-film luminescent layer, a thin-film second insulator layer and a thin-film rear electrode, which are sequentially laminated on the substrate, as described in SID 74 Digest of Technical Papers; pp. 84 to 85. The first and second insulator layers may be transparent dielectric thin films of $Y_2O_3$, $T_{a2}O_5$, $Al_2O_3$, $S_iN_4$, $B_aT_iO_3$ or $S_rT_iO_3$ of 0.2 to 1 thickness fabricated by a sputtering or vacuum evaporation method. These insulator layers aim at improving luminescence and stability of the EL device operation characteristics by limiting electric current passing through the luminescent layer as well as at enhancing the reliability of the EL device by protecting the luminescent layer from contamination by harmful ions and/or moisture.

The above mentioned devices, however, have several practical problems. More particularly, they are defective in that dielectric breakdown cannot be eliminated completely over a wide area which reduces production yield, and that the driving voltage applied on the device for emitting light becomes inevitably high as the voltage is divided and applied on the insulator layers. In order to solve the former problem of dielectric breakdowns, it is necessary to employ materials having superior dielectric characteristics for the insulator layers. For the latter problem, it is preferable to increase the capacity of the insulator layers in order to minimize the split of the voltage applied on the insulator layers.

The electric current passing through the luminescent layer is substantially proportionate to the capacity of the insulator layers according to the operating principle of such AC drive EL device. Therefore, increasing the capacity of insulator layers is critical for reducing driving voltage as well as for enhancing brightness. In short, the insulator layers should have a great resistance against dielectric breakdowns and a large capacity. As an index for evaluating the merits of insulating materials, a product of a dielectric constant ($\epsilon$) and a dielectric breakdown field (Eb.d.) is widely used. The minimum value of $\epsilon$.Eb.d. required for practical use is about three times as much as the $\epsilon$Eb.d. value (ca. 1.3 $\mu C/cm^2$) of ZnS luminescent layer. (Refer to IEEE Transactions On Electron Devices ED-24, pp. 903 to 908 (1977).) If an insulator material has an extremely large Eb.d. value, it may realize an insulator layer having a large capacity by taking the form of extremely thin films even if the value $\epsilon$ is small. But in practice, it is very difficult to completely eliminate pin holes or adhesion of particles over a large area which is required for a flat display or a surface-area light source. For such practical reason, it is not appropriate to employ insulator layers of thickness of several 100 Å or less.

Use of thin films of high dielectric constant is being reviewed from the aformentioned point of view. For instance, $PbTiO_3$ film fabricated by the sputtering method is used as an insulator layer in order to reduce driving voltage. (Refer to IEEE Transaction On Electron Devices ED-28, pp. 698–702 (1981).) The sputtered film of $PbTiO_3$ exhibits 0.5 MV/cm in dielectric strength at the maximum relative dielectric constant of 190, but the substrate temperature required during sputtering is as high as ca. 600° C., and this is not practical.

There has been known $SrTiO_3$ film fabricated by sputtering which can show fairly good $\epsilon$.Eb.d. value. (Refer to Japan Display 1983, pp. 76 to 79 (1983).) The sputtered film of $SrTiO_3$ has the relative dielectric constant of 140, dielectric breakdown voltage of 1.5 to 2 MV/cm, and $\epsilon$.Eb.d. value of 19 to 25 $\mu C/cm^2$. That value is higher than that of $PbTiO_3$ or 7 $\mu C/cm^2$. However, in the case of $SrTiO_3$ film, the substrate temperature during sputtering needs to be as high as 400° C., and moreover it reduces ITD transparent electrodes to blacken it during sputtering. It is detrimental also in that it cannot achieve a strong adherion with ZnS layer. Further, thin film EL devices using these insulator layers of relatively high dielectric constants tends to cause catastrophic propagating breakdowns, which are fatal in practice, rather than the breakdown of self-healing types which are completed to leave only the small problems.

As described in the foregoing, it is practically impossible to employ insulating thin films of high dielectric constant and $\epsilon$.Eb.d. value and still to achieve low working voltage, high brightness, desirable luminiscent characteristics and stability against dielectric breakdowns.

Due to the thermal processing required for improvement in stability and characteristics of EL devices, an expensive glass substrate should be used which is alkali-free and have high softening point. This factor inevitably increase the cost of thin-film EL devices. Even if such expensive glass is used, the temperature in the process should be limited to less than 600° C. The resistivity of ITO film used as a transparent electrode is not small enough. If the thickness of ITO film is increased in use, possibility of dielectric breakdown occurrence increases along ITO pattern edge. The thickness therefore should be limited to 0.2 $\mu m$ or less. The electrode resistance cannot be heretofore reduced to a satisfactory level, presenting a problem in realization of large area and large capacity displays.

Instead of using a glass plate as a starting substrate for forming thin-film structure, there has been proposed to use a high dielectric constant sintered ceramic substrate are formed a luminescent layer and a thin-film transparent electrode by thin-film fabrication technology. And a thin-film rear electrode is formed on the bottom surface of the sintered ceramic substrate by thin-film fabrication technology. (Refer to Japanese Patent Application No. 114461/82 which was published under Unexamined Patent Publication No. S-268/84.) This structure is advantageous in that it achieves low working voltage and high stability against dielectric breakdowns. However, the thickness of the high dielectric constant sintered ceramic substrate is selected as thin as 0.05 to 0.2 mm so as not to decrease coupling capacitance and thus results in small mechanical strength. For this reason, it can only realize an extremely small area EL device. If a large area display device is required, plural EL devices of a small area must be mounted on a rigid supporting member such as an alumina ceramic plate to have desired display patterns. Electric connection in such a case should be made by aligning pieces of EL devices with electrodes which are already formed on the alumina ceramic plate, requiring cumbersome works in manufacture. Furthermore, such fragile substrate should be handled with great care.

SUMMARY OF INVENTION

An object of this invention is to provide an EL device having a reliable starting substrate for forming a thin-film structure and which can emit light of high brightness at a low driving electric current with high reliability.

The EL device according to this invention is characterized by the use of a sintered multilayer ceramic plate with an internal electrode as a starting substrate for forming a thin-film structure.

It is favorable to insert an insulator layer between a luminescent layer and the starting substrate in order to prevent harmful ions diffused into the luminescent layer from the starting substrate, specially from a high dielectric constant ceramic region formed on the internal electrode.

In an electroluminescent device, according to the present invention, comprising a luminescent layer provided between a front electrode and a rear electrode, a first insulator layer provided between the luminescent layer and rear electrode, a ceramic base sandwiching the rear electrode with the first insulator layer, the improvement is that all of the first insulator layer, rear electrode and ceramic base are co-sintered together so as to provide a metal-ceramics composite monolithic substrate for laminating the luminescent layer thereon by means of thin-film fabricating process.

Furthermore, according to the present invention, an electroluminescent device comprises a metal-ceramics monolithic substrate having an internal electrode layer, the metal-ceramics monolithic substrate being produced by co-sintering laminated structure of ceramic green sheets with screen printed conductive paste layer sandwiched between said ceramic green sheets, a first insulator layer formed on the metal-ceramics monolithic substrate by means of thin-film fabricating process, a luminiscent layer formed on the first insulator layer by means of a thin-film fabricating process, a transparent second insulator layer formed on the luminescent layer by means of a thin-film fabricating process, and a transparent electrode layer formed on the second insulator layer by means of a thin-film fabricating process.

Moreover, according to the present invention, a method of manufacturing an electroluminescent device comprises the steps of: preparing a plurality of ceramic green sheets, at least one of the ceramic green sheets having a high dielectric constant, printing a rear electrode on one of said ceramic green sheets, making monolithic sintered member by laminating the ceramic green sheets and firing them together in a manner to internally install the rear electrode, forming an electroluminescent layer on the surface of the monolithic sintered member having a high dielectric constant, and forming a transparent front electrode on the electroluminescent layer.

A desired thickness of the monolithic member can be obtained by laminating a desired number of ceramic green sheets having appropriate thickness.

The portion of the monolithic substrate sandwiched between the internal electrode and the above first insulator layer has a larger thickness than that of the transparent second insulator layer and has a higher dielectric constant than that of the second insulator layer.

DETAILED DESCRIPTION OF PREFERRED EMBODIMENTS

Figure 1A:
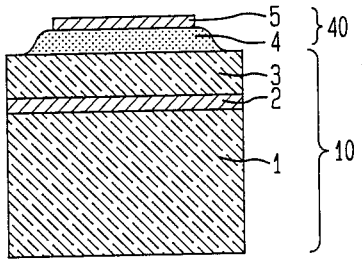
FIG. 1A and FIG. 1B show cross-sectional views of a basic structure of EL device according to the present invention.

Referring to FIG. 1A, the basic structure for the EL device according to the present invention consists of a metal-ceramics monolithic substrate portion 10 and a thin-film structure portion 40.

Figure 1B:
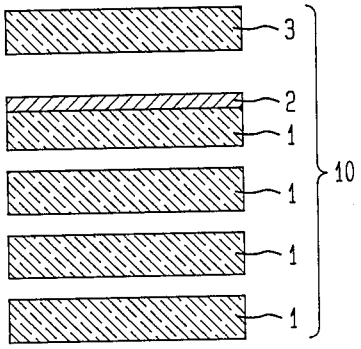

The monolithic substrate portion 10 consists of a ceramic base region 1 (1 mm thick as typical example), an internal electrode (1 to 3 μm thick) and a high dielectric constant ceramic insulator layer 3 (40 μm thick). The substrate 10 is fabricated by the green sheet laminating technology. A slurry, consisting of ceramic powder (a complex Perovskite compound $\{Pb(Ni_{\frac{1}{3}}Nb_{\frac{2}{3}})O_3-Pb(Mg_{\frac{1}{2}}W_{\frac{1}{2}})O_3-PbTiO_3\}$, developed for low firing multilayer ceramic capacitor) and organic vehicles, is cast into ceramic green sheets of 10 to 200 mm thick. The internal electrode 2 is printed on one of green sheets as shown in FIG. 1B. Then, these green sheets are laminated and fired at low sintering temperature, 900° to 1000° C. The low firing temperature green sheet laminating technology enables using cheap internal electrode materials, such as Ag/Pd alloy, to reduce the cost. The sintering shrinkage is about 20%. Grain size is less than 10 μm.

Vacuum evaporated ZnS:Mn thin film 4 (0.3 μm thick) as a luminescent layer is directly formed on the unpolished ceramic substrate surface of high dielectric constant layer 3. Mm concentrations is about 1 mol %. During ZnS:Mn depositions, substrate temperature is held at 200° C. ITO thin film 6 as a transparent front electrode is made by magnetron sputtering method. The desired thickness of the ceramic base layer 1 can be achieved easily by laminating a desired number of ceramic green sheets of appropriate thickness.

Figure 2:
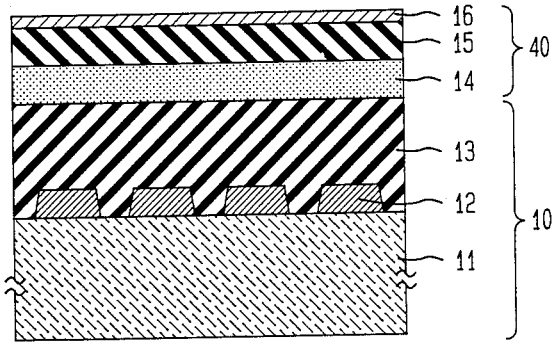
FIG. 2 is a cross-sectional view of EL device according to the first embodiment of the present invention.

FIG. 2 shows the first embodiment of the EL device according to this invention in matrix display structure which can minimize the aforementioned defects of the prior art. The device comprises a substrate portion 10 and a multilayer thin-film structure portion 40 formed on the substrate portion 10. The substrate portion 10 has a metal-ceramics composite co-sintered structure comprising an array of a plurality of thick-film first electrode layers 12 as internal row electrodes sandwiched between a ceramic base layer 11 and a first insulator layer 13 of a high dielectric constant material. The multi-layer thin-film portion 40 comprises a thin-film luminescent layer 14, a thin-film second insulator layer 15, and an array of a plurality of transparent second electrode layers 16, all of which are fabricated on the composite co-sintered substrate 10 by using thin-film fabrication method such as the vacuum evaporation, sputtering, CVD method. The structure may be a single insulated type omitting the thin-film second insulator layer 15. The luminescent layer 14 and the second insulator layer 15 are similar to those of the conventional thin-film EL device. In short, the first example of EL device according to this invention is characterized in that the base layer 11, the internal electrodes 12 and the first insulator layer 13 thereof are a laminated co-sintered monolithic structure formed by firing green sheets in lamination at the same time and that at least the first insulator layer 13 is made of a high dielectric constant material.

Such EL device is viewed from the side of the thin-film transparent electrode 16. Unlike the prior art device which uses a glass plate, the ceramic base layer, internal electrodes and first insulator layer do not have to be transparent, but rather should be colored darkly to enhance the contrast in display.

The above mentioned type of ceramics-metal-ceramics laminated monolithic structure can be manufactured by conventional green sheet laminating technology. More specifically, a slurry of ceramic powder and a binder is cast into thin ceramic green sheets. The thick-film electrodes as the internal electrodes 12 embedded in the laminated monolithic substrate are printed for example on a green sheet for the ceramic base layer 11 by screen print technology. Then, another green sheet is fabricated by the similar technology from a high dielectric constant material to form the first insulator layer 13. Thick-film printing of the internal electrodes may be formed on the green sheet for the first insulator layer 13. Then, the green sheet for the base layer 11 and first insulator layer 13 are laminated and pressed in a manner to embed the thick-film electrode layers, and fired to form a laminated monolithic structure as a starting substrate for forming thin-film portion 40. The base layer 11 may be formed the same material as that of the first insulator layer 13 as mentioned in the description referring to FIG. 1A and FIG. B, but preferably is made of inexpensive insulator ceramics of a low dielectric constant of alumina type or alumina mixed with glass frits for reducing the material cost and electrode capacitance. In an EL device, light is emitted from an area defined by the first and the second electrodes which perform both functions of electric supply and pixel display. The display is made in an arbitrary pattern in accordance with the particular application to various display devices. The pattern on the first electrodes is easily formed by any printing technique. Since EL device display pannels are infrequently required to form extremely fine electrode patterns, the screen printing technique would suffice. The technique has a merit of forming internal electrodes in a large area at a low cost. If fine patterns are needed, lithographic technique may be additionally used to form delicate patterns for thick-film internal electrodes.

As described above, the EL device according to this invention comprises a thin-film luminescent layer on a multilayer monolithic substrate with internal electrodes embedded therein. The structure can achieve large capacitance and high dielectric breakdown strength in the insulator layers by making the insulator layers, which are the critical component of an AC type EL device, with high dielectric constant ceramics. The relative dielectric constant of insulator thin films in the prior art thin-film EL devies is ca. 5 to 25 if made with ordinary materials, and ca. 100 to 100 if made with $PbTiO_3$ thin films. The latter figure is achieved only under strictly controlled manufacturing conditions. The ceramic structure obtained by firing laminated green sheets at the same time according to this invention can easily achieve a relative dielectric constant as high as 10,000 or higher if a suitable high dielectric constant material is selected. With such a high dielectric constant, it can realize the $\epsilon$. Eb.d. value several tens of hundred times more than the conventional thin-film insulating layers. Therefore, even if fabricated in the thickness of 40 $\mu$m, the capacity of the first insulator layer is larger by hundred times than that of ordinary insulator layers of $Y_2O_3$, $Si_3N_4$, $Ta_2O_5$, $Al_2O_3$, etc. generally employed in thin-film EL devices and larger by ten times than thin-film insulator layers of $PbTiO_3$ or $SrTiO_3$. The use of such high dielectric constant ceramic insulator layers realizes an insulator layer which is stable against dielectric breakdowns and still has a large capacitance to enable light emission at low working voltage and achieve highly bright luminous characteristics.

Such insulator ceramic layers of high dielectric constant can be manufactured at low cost to have a uniform thickness and a large area by the green sheet technology. The thickness thereof is preferably several microns or larger in view of production conditions and stability as a device. The thickness is also limited to preferably 300 $\mu$m or less as the capacity decreses in inverse proportion to the thickness although the local stability against dielectric breakdowns increases as the thickness increases, and a greater thickness presents the problem of cross talk with adjacent display pixels when used in a display. To clarify the merit achieved by the EL devices according to this invention, it is preferable to make the relative dielectric constant of the ceramic layers to be 200 or higher, although ceramic layers having a high dielectric constant of 1,000 to 20,000 can be manufactured from various material compositions by the green sheet technology. Generally, however, it requires high firing temperature in an oxidized atmosphere and expensive precious metal pastes of Pt, Au, Pd, etc. are needed for the first electrodes. When considering the ease in manufacture and stability characteristics, it is most preferable to use highly dielectric materials of a low temperature firing type, a typical representation of which is complex Perovskite compound containing Pb. In expensive Ag or Ag-Pd alloys containing a large amount of Ag may be used.

As described in the foregoing, the EL device according to this invention ca be obtained by fabricating luminescent layer on a composite ceramic substrate having internal electrode by such thin-film forming process as deposition or sputtering. The top surface of the first insulator layer 13 may be polished before fabricating the luminescent layer but even if unpolished and fabricated with luminescent layer directly, no particular problems occur.

(Embodiment 1)

Powder mixture of alumina and borosilicate glass was blended with a binder to make a slurry and cast into a ceramic green sheet of 0.7 mm thickness for the base layer 11. Ag-Pd alloy paste was screen-printed on the ceramic green sheet to form a striped pattern of 0.33 mm width at 0.55 mm pitch. The Ag-Pd alloy paste contains 85 atomic % of Ag and 15 atomic % of Pd. As a complex Perovskite compound containing Pb for low temperature firing, an unbaked powder of {0.925 $(Ni_{\frac{1}{3}}Nb_{\frac{2}{3}})O_3$—0.925 Pb $(Mg_{\frac{1}{2}}W_{\frac{1}{2}})$ $O_3$—0.41 $PbTiO_3$} was mixed with a binder and cast into a green sheet of 40 mm thickness for the first insulator layer 13. The green sheet was laminated and processed on said base green sheet which had been printed with electrode pattern and unnecessary edges were cut off. It was fired at 950° C. to form a multilayer ceramic structure. After baking, the shrinkage of ca. 10% was observed. Then ZnS:Mn was deposited on it by coevaporation method of ZnS and Mn in the thickness of 0.3 μm. It was further heat-processed with Ar for two hours at 650° C. for improving characteristics. Then, using a target mixture of $Ta_2O_5$ and $SiO_2$, a $Ta_2SiO$ insulator layer was fabricated in the thickness of 0.2 μm by sputtering to be used as the second insulator layer. Then, an ITO coating was formed by sputtering in the thickness of 0.4 μm and etched in 0.3 m width at 0.5 mm pitch in the pattern perpendicular to said Ag-Pd thick-film stripe electrode to form transparent striped electrodes. As the ITO coating was as thick as 1.4 μm, the sheet resistance was ca. 5 ohm, a sufficiently low value.

The EL device thus formed had an extremely large capacitance in the first ceramic insulator layer, and therefore almost no voltage drop occurred in the layer. As the crystallinity and Mn distribution were improved by heat processing at high temperature and as the electrode resistance was low, the voltage needed for initiating light emission was as low as 55V at AC pulse voltage application, and the luminous brightness was ca. 500 $Cd/m^2$ at 80V 500 Hz, advantageous characteristics. When the second insulator layer was removed to form a single insulated type structure, the electric current value become large to deteriorate the luminous efficiency, but the voltage which initiates light emission was as low as 25V, and the luminous brightness was similar to the above. The device of this embodiment showed a high stability as there was no dielectric breakdown failure observed at when the voltage up to 350V was applied.

The excellent luminous characteristics and stability were obtained when $ZnS:TbF_3$ which emits green light or $ZnS:SmF_3$ which emits red light was used as the electroluminescent layer instead of ZnS:Mn. Therefore, merit of the EL device according to this invention was verified.

As heretofore described, the EL device in Embodiment 1 was highly stable, needed low drive voltage, emitted highly bright light, and showed high contrast. As the electrode resistance thereof could be limited low, the device is applicable to a wide range from segment display to dot matrix display of large display capacity. There was hardly any dielectric breakdown failure observed in the device and the yield was improved. Compared to the prior art device which extensively uses expensive glass bases and thin-film processing, this invention device can be manufactured at lower cost. As the device can be driven at a lower voltage, the cost of the drive circuit of this device can be considerably reduced. The industrial value of this invention is therefore enormous.

As mentioned above, the basic structure embodied in the first embodiment achieved a remarkable improvement. But when the device was left to emit light for a long time, the brightness decreased. Another embodiment of EL device having a high dielectric constant ceramic layer as a insulator layer which is remarkably advantageous and yet can prevent reduction in brightness will now be described referring to FIG. 3.

Figure 3:
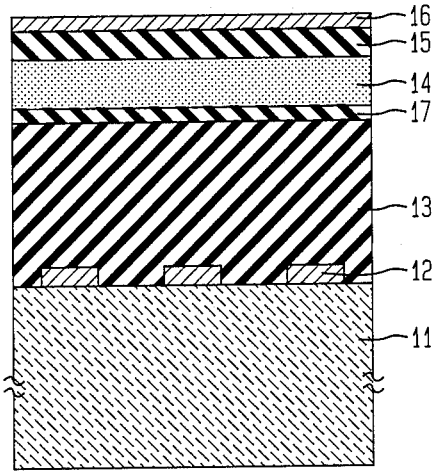
FIG. 3 is a cross-sectional view of EL device according to the second embodiment of the present invention.

The EL device shown in FIG. 3 comprises internal electrode 12, a high dielectric constant ceramic first insulator layer 13, a thin-film insulator buffer layer 17, a luminescent layer 14, a thin-film second insulator layer 15 and a thin-film transparent electrode 16 which are laminated on a base layer 11. The only difference from the structure shown in FIG. 2 is the presence of a thin-film buffer layer 17 inserted in the structure. Namely this embodiment is characterized in that an additional insulator layer is inserted between the high dielectric constant ceramic layer and the luminescent layer. Other component layers are not necessarily the same as shown in FIG. 2. For example, the second thin-film insulator layer 15 may be omitted to form a so-called simple insulated type structure. The inserted thin-film layer 17, which is an insulator thin film fabricated by sputtering, vacuum evaporation, or plasma CVD method, is not necessarily transparent, but may be a thin film which is colored to enhance a display contrast. Stable, oxides such as $Ta_2O_5$, $Y_2O_3$, $SiO_2$, SiO, $Sm_2O_3$, $Al_2O_3$, TaSiO, TaAlO, $BaTiO_3$, or $SrTiO_3$, insulating nitrides such as $SiN_4$, or fluorides such as $CaF_2$ may generally be used. The thickness of the layer 17 is not necessarily too large, but may be in the range of 0.02 to 0.2 μm. It it is made thick, as the voltage should be increased. It it is made extremely thin, however, the drop in brightness of the light emission of the EL device cannot be fully prevented. Although the exact reason why the EL device having a high dielectric constant ceramic layer should deteriorate the brightness thereof after a long time use is not known, it is presumably because harmful ions diffuse from the ceramic layer to the interface or to the luminescent layer. The use of the thin film buffer layer 17 in the second embodiment presumably prevents the diffusion of harmful ions. When an oxide film containing Ta was used in the thickness of 0.1 μm or less as buffer layer, it was found that the drive voltage did not have to be increased even if the layer 17 was inserted, and the brightness was improved.

(Embodiment 2)

An EL device which is shown in cross section in FIG. 3 was manufactured according to the steps described below;

A powder of alumina and borosilicate glass was blended with a binder to make a slurry, cast into a green sheet of 0.7 mm thickness which was to be used as a ceramic base layer 11. The ceramic green sheet was screen-printed in the strip pattern of 0.33 mm width and 0.55 mm pitch with Ag-Pd paste of 85 atomic % of Ag and 15 atomic % Pd to form electrodes 12. As a typical example of complex Perovskite compound containg Pb for low temperture firing, unbaked powder of {0.295 $(N_{\frac{1}{3}}Nb_{\frac{2}{3}})$ $O_3$—0.295 Pb $(Mg_{\frac{1}{2}}W_{\frac{1}{2}})$ $O_3$—0.41 $PbTiO_3$} was mixed with a binder, cast to form a green sheet of 40 μm thickness for a high dielectric constant ceramic insulator layer 13. This green sheet was laminated on the green sheet printed with the electrode pattern 12, removed of unnecessary portion from edges, and fired at 950° C. to form a laminated ceramic structure. Firing shrinkage was ca. 10%, A $Ta_2O_5$ film was formed in 0.05 μm thickness by the radio frequency magnetron sputtering to be used as a thin-film insulator buffer layer 17.

Then, ZnS:Mn was vacuum evaporated to achieve 0.3 μm thickness by the coevaporation method of ZnS and Mn. It was then sputtered by the radio frequency magnetron sputtering method to form a film of $Ta_2O_3$ in the thickness of 0.3 μm to be used as the second thin-film insulator layer 15. An ITO film was then coated in the thickness of 0.3 μm by the radio frequency magnetron sputtering method. The pattern was arranged with resists to perpendicularly cross the Ag-Pd thic-film stripe electrode in advance, and the ITO film was made into stripes by the lift-off method to form transparent electrodes 16.

When an AC pulse voltage was applied on these fabricated EL devices, it started light emission from 55V and emitted light of high brightness at the low voltage of 88V, 200 Hz in ca. 200 cd/m$^2$. The ceramic layer was of dark brown color, and display in high contrast was made. Even if an extremely large voltage of 350V was applied, no device burnout was caused by dielectric breakdown.

Figure 4:
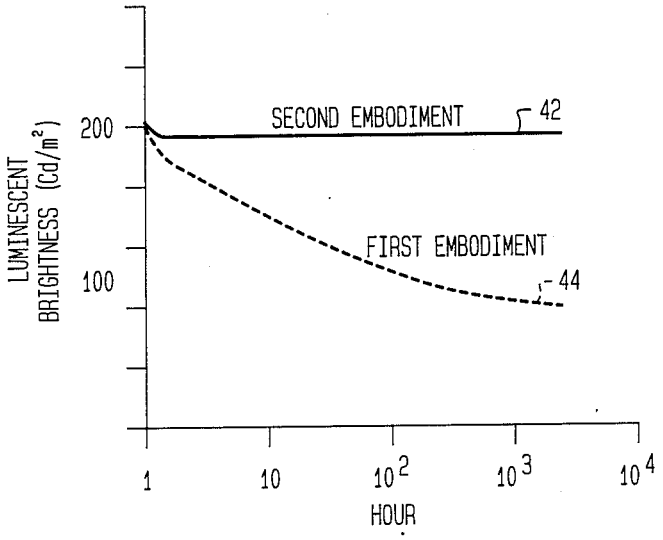
FIG. 4 is a characteristic graph to show the relation between the working time and the brightness of the EL devices of the first and second embodiment.

The graph in FIG. 4 shows by solid lines 42 the changes in brightness when the device was operated for a long time at 200 Hz, 80V in a dry nitrogen atmosphere. Almost no drop in brightness was observed after 1,000 hour operation. The result of similar experiment on the EL device obtained in the first embodiment which had no thin-film insulating layers is shown in broken line 44 in FIG. 4 for comparison. The test condition were the same the first embodiment device exhibited a considerable drop in brightness after ca. 200 hour operation and a gradual decrease thereafter. The insertion of the thin-film buffer layer obviously reduced the drop in brightness. The effect of the $Ta_2O_5$ inserted layer was similarly observed in other materials such as $Al_2O_3$, $Y_2O_3$, SiN, etc. When Zn:$TbF_3$ of dielectric emission or ZnS:$SmF_3$ of red light emission was used as the emissive layer instead of ZnS:Mn, the effect of the thin-film insulating layer was similar to prove the efficiency of the EL device structure of the second embodiment.

As described above, the second embodiment EL device retains all the merits of the EL device using a high dielectric constant ceramic insulator layer such as low working voltage, high brightness in emission, high contrast, no dielectric breakdown, high yield, etc. and still further achieves stability of brightness characteristics over a long period of time and thus proves of a remarkable industrial utility.

In the foregoing embodiments of dot matrix display device, however, the power consumption was considerably larger than the conventional thin film dot matrix display device. The IC for driving was required a large current capacity although working voltage required may be relatively low. These defects presented formidable obstacles for the application of EL device with high dielectric constant ceramic layers for dot matrix display devices of a large display capacity.

The third embodiment of this invention aims at providing a display device which alternates the problems caused when such high dielectric constant ceramic layer EL device was applied as a dot matrix display device and which is highly stable and is driven at a low voltage.

The third embodiment of this invention was based upon the findings that the increases in power consumption or drive current were caused by the capacity coupling between juxtaposed electrodes when EL device having high dielectric constant ceramic layers are applied to dot matrix display devices. More particularly, an EL device is a capacitive device and power needed for charging/discharging the device takes up most of the power consumed by the display device. The charging/discharging power is proportionate to a product of the squares of volume and capacity. The capacity in the EL devices having high dielectric constant ceramic insulating layers is large. But as the power is in proportionate to the square of the voltage, no overall increase in power consumption is caused. What is more problematic is the necessity that it should have electrodes in the form of long stripes arranged in parallel at a small pitch in order to achieve dot matrix display. The capacity between these internal electrodes in the form of stripes and between transparent electrodes becomes large. The coupling capacity between internal electrodes becomes especially large. This is because layers of a considerably larger thickness than prior art thin films and of a remarkably high dielectric constant are formed in a manner to envelop the internal electrodes formed in stripe as shown in FIG. 2. The coupling capacity here is 10,000 times as much as the coupling capacity between stripe electrodes of a prior art thin-film dot matrix type EL device. This is a value not to be ignored when it is driven as a display device.

The following embodiment discloses a device structure which is free from aforementioned problems and the manufacturing method therefor.

Figure 5:
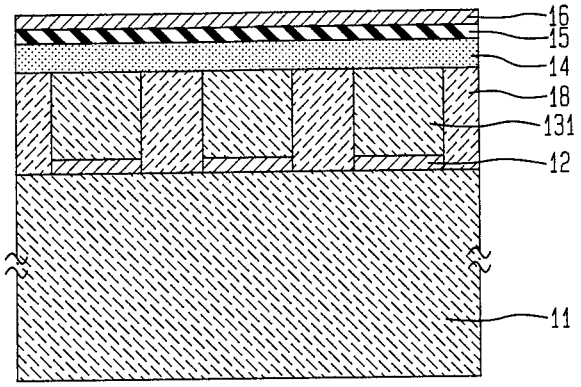
FIG. 5 is a cross-sectional view of EL device according to the third embodiment of the present invention along the longitudinal direction of the transparent electrode thereof.
Figure 6:
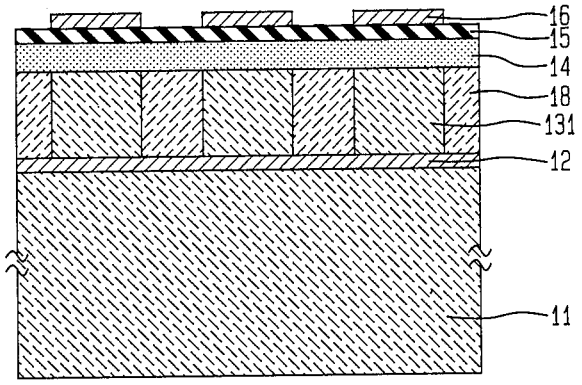
FIG. 6 is a cross-sectional view of the third embodiment of the present invention EL device along the longitudinal direction of the internal electrode thereof.

FIG. 5 shows in cross section the basic structure of the third embodiment of the EL devices according to this invention. On a ceramic base layer 11 are formed co-sintered internal electrodes 12 in the form of stripes, and a co-sintered ceramic layer partially divided into high dielectric constant ceramic portions. Upon such ceramic layer are formed sequentially a luminescent layer 14, a second thin-film insulator layer 15 and transparent electrodes 16 which are formed in lattice and perpendicular to the internal electrodes 12. While the high dielectric constant ceramic insulating layers in aforementioned embodiments is characterized in that such layer is partitioned by low dielectric constant materials. As is obvious from FIG. 5, the coupling capacity between internal electrodes, 12, 12, . . . in the stripe pattern can be remarkably reduced. Although the coupling capacity between transparent electrodes 16, 16, . . . is smaller than that between electrodes 12, 12, . . . due to the luminescent layer and the second insulator layer of low dielectric constant, it may be further reduced by partitioning the high dielectric constant portions with low dielectric constant material as shown in FIG. 6. In this case, high dielectric constant material is allotted like islands at the junctions of the internal electrodes 12 and the transparent electrodes 16 which form a luminous display.

Figure 7:
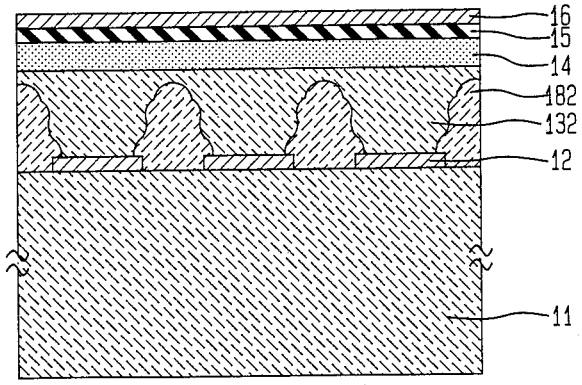
FIG. 7 is a cross-sectional view of a modification of the third embodiment of the present invention.

As shown in FIG. 7, a remarkable drop in coupling capacity is achieved even if the high dielectric constant ceramic portion 132 is not fully divided with low dielectric constant ceramic portions 182 but is slightly separated to some extent.

The above mentioned structures may be realized by various manufacturing methods. For instance, the EL device of this embodiment may be produced by the steps of screen printing the internal electrodes in stripes on an alumina ceramic substrate and firing the same, printing thereon the paste of mixture of alumina powder, glass firts in the form of mesh and drying the same, and screen printing the paste of mixture of fine powder of $BaTiO_3$ group and glass frits in a manner to fill the voids of said mesh, to thereby from islands and bake the same. However, as the paste tends to cause drains and fins when screen-printed with this method, the shapes of emissive pixels become not uniform. The surface, moreover, becomes considerably irregular by printing patterns. The paste for high dielectric constant insulating layers so far dielectric constant of ca. 2,000 at maximum. Ceramic layers of higher dielectric constants are more desirable.

It is therefore prefarable to manufacture green sheets of 10 to 150 m in thickness which are respectively divided into grid of high and low dielectric constant materials, laminating it on a ceramics green sheet so as to sandwich the internal electrodes and firing them at the same time to form a laminated monolithic ceramic substrate portion.

(Embodiment 3)

In this embodiment, an EL display device of dot matrix type having 128 scanning lines and data lines at pixel pitch of 0.5 mm was made. FIGS. 5 and 6 show cross sectional views thereof.

Figure 8:
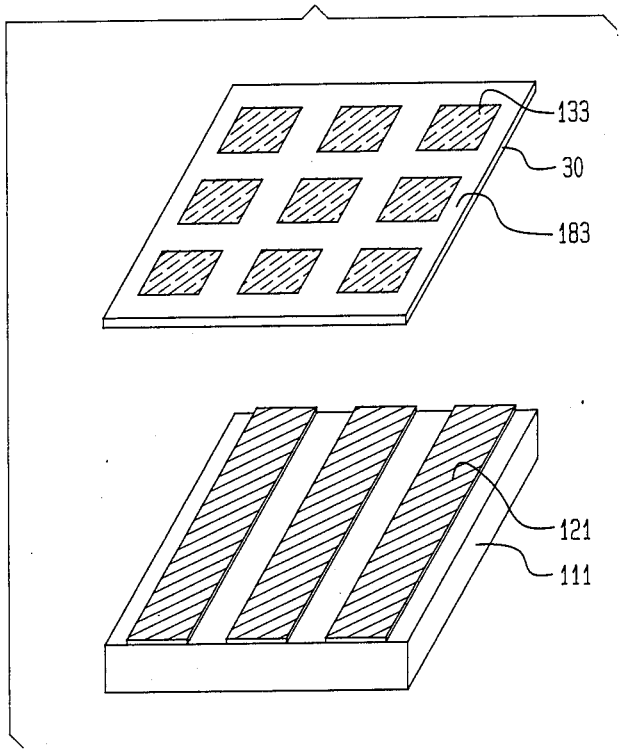
FIG. 8 is a perspective view to show laminating process of the lamination ceramic green sheets of the third embodiment of this invention.

The manufacturing method thereof will now be described. A slurry mainly consisting of alumina powder and lead glass frits was processed into plate by Doctor's blade method, dried and formed as green sheets. This was to be used as a ceramic base layer 11 and had a thickness of ca. 0.5 mm. A conductive paste of Ag-Pd alloy was screen-printed on said green sheet at 0.55 mm pitch and 0.33 mm width. FIG. 8 shows the state wherein the reference numeral 111 denotes a base green sheet and 121 printed electrodes. Separately from these green sheets, a slurry of the same type of alumina powder and lead glass frits was cart into a sheet of 40 μm thickness by Doctor's blade method, dried and formed as green sheets. The green sheets were punched with a metal die to form 0.33 mm square holes at 0.55 mm pitch in the state shown in FIG. 8. The number of the holes was 128×128. Unbaked powder of $\{0.295\ Pb(Ni_{\frac{1}{3}}Nb_{170})\ O_3—0.295Pb(Mg_{\frac{1}{2}}W_{\frac{1}{2}})\ O_3—0.41\ PbTiO_3\}$ which was a complex Perovskite compound containing lead and had a dielectric constant as high as ca. 15,000 was made into paste and embedded into the holes on the green sheet by the screen printing method. Insulating layer green sheets were produced by drying the above green sheets to have high dielectric constant material 133 surrounded by low dielectric constant substance 183 in grid pattern. The above green sheet was laminated upon the base or the green sheet with printed electrodes in alignment therewith and pressed tightly, and baked at 950° C. Firing shrinkage was ca. 10%. On this laminated ceramic substrate was deposited ZnS:Mn in the thickness of 0.3 μm by the vacuum evaporation method, and further formed an oxide compound of TaSiO by sputtering. ITO film was formed by sputtering in the thickness of 0.3 μm as transparent electrodes in striped perpendicular to internal electrodes in alignment thereto. Thus-made EL display device strongly emits light when applied with a low AC pulse voltage of 80V, and was extremely stable when applied a voltage as high as 350V without causing dielectric breakdowns.

The coupling capacity between internal electrodes and between transparent electrodes was reduced to 1/100 or less of the prior art because they were partitioned with low dielectric constant substance of $\epsilon$=ca.8 compared to the EL device of the structure shown in FIG. 2, this structure required only one half of the power and one half of the electric current capacity in IC for driving.

In the manufacturing steps of this embodiment, the internal electrodes are not necessarily printed on green sheets of ceramic base but may be printed on the green sheets for insulating layers.

This embodiment successfully solved the problems encountered in the conventional thin-film EL devices which comprise thin films alone, problem being such as large power consumption and large current capacity borne on ICs for driving when EL devices having high dielectric constant ceramic insulating layers are used to achieve low working voltage and stability, and is highly effective when applied as a display device of a large display capacity to fully utilize the merits of high dielectric constant ceramic insulating layers in the EL device.

A dot matrix EL display device forms rear electrodes and transparent front electrodes in stripes perpendicularly crossing each other, uses them as scanning electrodes and data electrodes and forms respective pixels at the area defined by crossing electrodes of both types. Both electrodes extend from the central display are to the periphery of the glass substrate to form lead-out terminals.

The drive circuits may be formed as external drive circuits on a printed circuit board or a flexible circuit plate and are connected to the electrode lead out terminals on the display panel.

In the conventional thin-film EL display device such as above, the display panel and the drive circuit board are separately provided, therefore a high density connection in a large number corresponding to the number of electrodes must be carried out. Compared to liquid crystal devices, EL devices require solder connection of a higher reliability because of larger current and voltage for driving, thus increasing the cost. The remarkable feature of an EL display device or the thinness will be hampered if a drive circuit base is mounted behind a display panel.

The fourth embodiment according to this invention aims to realize a novel structure of EL display device which obriate various defects of the conventional EL display devices mentioned above.

(Embodiment 4)

Figure 9:
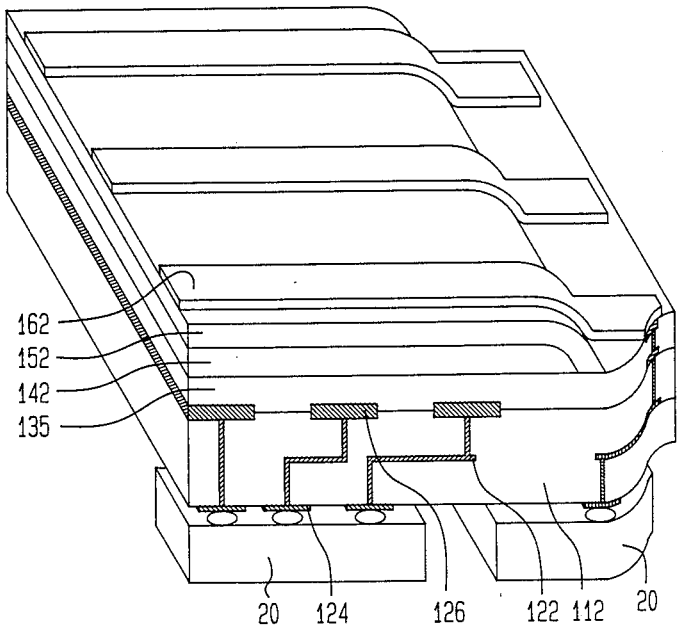
FIG. 9 is a sectional/perspective view to show EL device according to the fourth embodiment of this invention.

The fourth embodiment according to this invention is shown in FIG. 9. The EL display device of this embodiment is for dot matrix display and is divided into sections; a laminated monolithic ceramic substrate portion and a thin film structure portion. The substrate portion comprises a ceramic base 112, wiring electrodes 122, lead-out electrodes 124, display electrodes 126, and a first insulating layer 135 and was manufactured by the green sheet laminating method. The ceramic base was prepared mainly from alumina and horosilicate glass powder while the first insulating layer was prepared from complex Perovskite compound containing lead. They were mixed with a binder to form a slurry, and cast into green sheets. The green sheet was punctured to form via holes and then screen-printed to form a predetermined electrode pattern. Those green sheets were pressed on each other in alignment and fired. The display electrodes 126 were formed in stripes at 0.5 mm pitch and 0.3 mm width to be used as the electrodes on the scanning side of the dot matrix display device while the electrodes 124 on the back side were patterned so as to allow an easy package of circuit components such as ICs for driving and and wired internally from the internal electrodes 122.

For manufacturing the laminated ceramic layer, the ceramic material for low temperature firing was used. An inexpensive AgPd alloy paste containing a small amount of Pd was employed as a conductor. The firing temperature was 950° C. Although it was simply illustrated in FIG. 9, the ceramic base 112 in this embodiment comprises three green sheets of ca, 0.3 mm thickness. The first insulating layer 135 had the thickness of ca. 40 μm. The relative dielectric constant was ca. 15,000. A ZnS luminescent layer 142 containing ca. one mole % of Mn was formed on the laminated ceramic substrate in the thickness of 0.4 m by vacuum evaporation method and then an oxide compound of TaSiO was coated thereon by sputtering as the second insulating layer 152. Then, ITO transparent electrodes 162 were formed in stripes perpendicular to the display electrodes 126 to be used as the electrodes on data side. These transparent electrodes were wired to the lead-out electrodes on the back side-via wiring electrodes. High-voltage strength ICs for driving were carried on the back side of the ceramic substrate to be bonded to each lead out electrode.

As driving circuits are combined integrally in the above EL display device wherein an EL display section and lead-out electrodes are formed on both surfaces of a ceramic substrate which is internally wired, the problem of connection encountered in the prior art external drive type circuit system is solved. This allows a larger space allocation for display against the device area and reduces the thickness of the device. The internally wired ceramic substrate is realized by the green sheet dielectric constant ceramic layers may be easily manufactured as the first insulating layer by the same process. These EL display devices are excellent in stability against dielectric breakdown, low voltage driving and highly bright light emission.

Segment display can be also realized in this embodiment structure.

This invention display device has a great industrial value costwise as a whole compared to the prior art device wherein EL device is formed on a glass substrate and a driving circuit is separately manufactured to be connected thereto from outside.

In describing the invention, reference has been made to preferred embodiments. Those skilled in the art, however, and familiar with the disclosure of the subject invention, may recognize additions, deletions, substitutions, modifications and/or other changes which will fall within the purview of the invention as defined in the following claims.

What is claimed is:

1. An electroluminescent device comprising:

a monolithic substrate portion and a multilayer thin-film structure portion laminated on said substrate portion;

said substrate portion having an internal electrode region embedded therein, and said thin-film structure portion including a luminescent layer and a transparent electrode layer such that said luminescent layer is sandwiched between said transparent electrode layer and said substrate portion, and said internal electrode region and said transparent electrode layer being arranged to define a light emitting area of said luminescent layer;

said substrate portion being formed by heating at a sintering temperature, laminated ceramic green sheets and a conductive paste layer disposed between two of said ceramic green sheets.

2. An eleotroluminescent device as recited in claim 1 wherein an insulator region of said substrate portion is sandwiched between said internal electrode region of said monolithic substrate portion and said luminescent layer; said sandwiched insulator region being made of material having a dielectric constant higher than 200.

3. The electroluminescent device as claimed in claim 2 wherein a thin-film first insulator layer is provided between said luminescent layer and said transparent electrode layer to electrically insulate said transparent electrode layer from said luminescent layer.

4. The electroluminescent device as claimed in claim 1, wherein said monolithic substrate portion comprises ceramic material having a dielectric constant larger than 200, and an internal electrode layer embedded in said ceramic material.

5. The electroluminescent device as claimed in claim 2 wherein a thin-film second insulator layer is provided between said luminescent layer and said monolithic substrate portion to prevent ions from diffusing from said insulator region having a high dielectric constant to said luminescent layer of said thin-film structure portion.

6. The electroluminescent device as claimed in claim 2 wherein said internal electrode region is divided into a plurality of segments, and said insulator region extends between said internal electrode segments;

said insulator region is divided into a first and a second sub-region, said first sub-region having a higher dielectric constant than said second sub-region;

said first sub-region having segments located immediately above each internal electrode segment between said thin-film structure portion and said internal electrode segments, and separated from each other by portions of said second sub-region;

said second sub-region having segments respectively located between two internal electrode segments and also extending to said thin-film structure portion.

7. The electroluminescent device as claimed in claim 1 wherein said substrate portion is provided on the bottom thereof with an external terminal electrode, and said internal electrode and said external terminal electrode are electrically connected via a conductor provided internally in said substrate.

8. An electroluminescent device comprising: a metal-ceramics co-sintered substrate having an internal electrode layer embedded within ceramics; a first insulator layer formed on said ceramic substrate; a luminescent layer formed on said first insulator layer, a transparent second insulator layer formed on said luminescent layer, a transparent electrode layer formed on said second insulator layer so as to oppose said internal electrode layer, and the portion of said ceramic substrate sandwiched between said internal electrode layer and said first insulator layer having a larger thickness than that of said second insulator layer and having a higher dielectric constant than that of said second insulator layer.

9. The electroluminescent device as claimed in claim 8 wherein said first insulator layer consists of material selected from one of $Ta_2O_5$, $Y_2O_3$, $SiO_2$, SiO, $Sm_2O_3$, $Al_2O_3$, TaSiO, TaAlO, $BaTiO_3$, $SrTiO_3$, $Si_3N_4$ and CaF, and said luminescent layer consists of material selected from one of ZnS:Mn, $ZnS:TbF_3$ and $ZnS:SmF_3$.

10. An electroluminescent device as recited in claim 2 wherein said internal electrode region is divided into a plurality of segments, and said insulator region extends between said internal electrode segments;

said insulator region is divided into a first and a second sub-region, said first sub-region having a higher dielectric constant than said second sub-region;

said second sub-region having segments respectively located between two said internal electrode segments and separated from each other by said first insulator sub-region.

11. An electroluminescent device as recited in claim 2 wherein said sandwiched insulator region is divided into alternating first and second segments all of which extend from said internal electrode region to said thin-film structure portion;

the dielectric constant of each said first segment being less than that of each second segment.

12. An electroluminescent device as recited in claim 11 wherein said transparent electrode layer is divided into a plurality of spaced segments respectively located in vertical alignment with a corresponding one of said second segments.

* * * * *